US007699155B2

(12) United States Patent
Aas et al.

(10) Patent No.: US 7,699,155 B2
(45) Date of Patent: Apr. 20, 2010

(54) APPARATUS FOR RECEIVING AND DISTRIBUTING CASH

(75) Inventors: Per Christian Aas, Oslo (NO); John Haakon Lippert, Klokkarstua (NO)

(73) Assignee: Scan Coin AB, Malmö (SE)

( * ) Notice: Subject to any disclaimer, the term of this patent is extended or adjusted under 35 U.S.C. 154(b) by 2 days.

(21) Appl. No.: 11/940,823

(22) Filed: Nov. 15, 2007

(65) Prior Publication Data

US 2008/0149455 A1 Jun. 26, 2008

Related U.S. Application Data

(60) Division of application No. 10/025,336, filed on Dec. 19, 2001, now Pat. No. 7,066,335, and a continuation of application No. 11/111,588, filed on Apr. 21, 2005, now abandoned, which is a continuation of application No. 10/025,336, filed on Dec. 19, 2001, now Pat. No. 7,066,335.

(51) Int. Cl.
*G07F 9/00* (2006.01)
*G07D 1/00* (2006.01)

(52) U.S. Cl. ..... 194/342; 453/18

(58) Field of Classification Search ..... 194/342, 194/343; 221/264, 265; 453/21–28, 43–48
See application file for complete search history.

(56) References Cited

U.S. PATENT DOCUMENTS

| | | | | |
|---|---|---|---|---|
| 76,492 | A | 4/1868 | Meaker | |
| 346,564 | A | 8/1886 | Seegmueller | |
| 2,376,880 | A * | 5/1945 | Mills | 453/37 |
| 2,863,464 | A | 12/1958 | Hewitt et al. | |
| 3,038,157 | A | 6/1962 | Simjian | |
| 3,131,702 | A | 5/1964 | Buchholz et al. | |
| 3,731,695 | A | 5/1973 | Meijer | |
| 3,828,166 | A | 8/1974 | Johansson et al. | |
| 3,970,992 | A | 7/1976 | Boothroyd et al. | |
| 3,998,237 | A | 12/1976 | Kressin et al. | |
| 4,010,766 | A | 3/1977 | Bowles et al. | |
| 4,108,518 | A | 8/1978 | Angst | |
| 4,150,740 | A | 4/1979 | Douno | |

(Continued)

FOREIGN PATENT DOCUMENTS

| | | |
|---|---|---|
| CA | 2 299 747 | 9/2001 |

(Continued)

OTHER PUBLICATIONS

Security Cash Register, IBM Technical Disclosure Bulletin, http://www.delphion.com/tdbs/tdb?o (1973).

(Continued)

*Primary Examiner*—Patrick Mackey
*Assistant Examiner*—Mark Beauchaine
(74) *Attorney, Agent, or Firm*—Womble Carlyle Sandridge & Rice, PLLC

(57) ABSTRACT

The present invention relates to methods and systems for receiving and distributing currency. In particular, the present invention provides a novel apparatus for the inflow and outflow of a variety of currency. The systems of the present invention are capable of recycling a variety of currency from multiple countries and multiple denominations. The systems of the present invention have the added advantage of compact size.

21 Claims, 4 Drawing Sheets

U.S. PATENT DOCUMENTS 4,304,247 A 12/1981 Hasegawa
4,337,864 A 7/1982 McLean
4,403,900 A 9/1983 Thomas
4,412,550 A 11/1983 Wantanbe et al.
4,479,049 A 10/1984 Hirose
4,558,712 A 12/1985 Sentoku et al.
4,620,559 A 11/1986 Childers et al.
4,632,621 A 12/1986 Cable
4,687,089 A 8/1987 Weuthrich
4,697,071 A 9/1987 Hiraoka et al.
4,733,765 A 3/1988 Watanabe
4,866,254 A 9/1989 Okayama et al.
4,946,341 A 8/1990 Parsley et al.
4,997,405 A * 3/1991 Dabrowski ..... 453/57
5,005,688 A 4/1991 Yukimoto et al.
5,064,074 A 11/1991 Edin et al.
5,067,928 A 11/1991 Harris
5,183,142 A 2/1993 Latchinian et al.
5,295,899 A 3/1994 Adams et al.
5,366,407 A 11/1994 Sentoku
5,429,551 A 7/1995 Uecker et al.
5,469,951 A 11/1995 Takemoto et al.
5,474,497 A * 12/1995 Jones et al. ..... 453/17
5,480,348 A 1/1996 Mazur et al.
5,533,627 A 7/1996 Nordqvist
5,542,519 A 8/1996 Weston et al.
5,549,444 A 8/1996 Dubuit
5,560,467 A 10/1996 Takemoto et al.
5,607,351 A 3/1997 Schwartz
5,628,258 A 5/1997 Zwahlen et al.
5,671,666 A 9/1997 Wenglar
5,680,935 A 10/1997 Mistander et al.
5,718,625 A 2/1998 Bointon
5,722,882 A 3/1998 Kashiwagi et al.
5,755,437 A 5/1998 Ek
5,813,510 A 9/1998 Rademacher
5,830,054 A 11/1998 Petri
5,860,935 A 1/1999 Blaszynski et al.
5,864,826 A 1/1999 Awatsu et al.
5,875,259 A 2/1999 Mennie et al.
5,918,748 A 7/1999 Clark et al.
5,923,413 A 7/1999 Laskowski
5,960,103 A 9/1999 Graves et al.
5,966,456 A 10/1999 Jones et al.
5,975,273 A 11/1999 Zwahlen et al.
5,982,918 A 11/1999 Mennie et al.
5,992,602 A 11/1999 Zwieg et al.
5,997,395 A 12/1999 Geib et al.
6,003,652 A 12/1999 Murata et al.
6,006,989 A 12/1999 Ademmer et al.
6,047,886 A 4/2000 Saltsov
6,059,090 A 5/2000 Davis et al.
6,061,121 A 5/2000 Holl et al.
6,068,194 A 5/2000 Mazur
6,074,081 A 6/2000 Smith et al.
6,082,616 A 7/2000 Lewis et al.
6,086,471 A 7/2000 Zimmerman
6,098,837 A 8/2000 Izawa et al.
6,101,266 A 8/2000 Laskowski et al.
6,109,522 A 8/2000 Force et al.
6,128,402 A 10/2000 Jones et al.
6,131,809 A 10/2000 Drescher et al.
6,135,291 A 10/2000 Canella
6,145,737 A 11/2000 Imai et al.
6,170,818 B1 1/2001 Eastman et al.
6,220,954 B1 4/2001 Nguyen et al.
6,237,739 B1 5/2001 Mazur et al.
6,241,244 B1 6/2001 Modi
6,289,261 B1 9/2001 Heidel et al.
6,290,070 B1 9/2001 Graef et al.
6,367,692 B1 4/2002 Junkins et al.
6,371,473 B1 4/2002 Saltsov et al.
6,422,458 B1 7/2002 Katou et al.
6,481,620 B1 11/2002 Katou et al.
6,502,746 B1 1/2003 Do et al.
6,637,576 B1 10/2003 Jones et al.
6,640,156 B1 10/2003 Brooks et al.
6,640,956 B1 11/2003 Zwieg et al.
6,655,584 B1 12/2003 Lundblad
6,712,219 B2 3/2004 Kobayashi et al.
6,736,311 B2 5/2004 Hagglund et al.
6,758,737 B2 7/2004 Svensson
7,051,926 B2 5/2006 Saltsov et al.
7,066,335 B2 6/2006 Aas et al.
7,278,527 B2 10/2007 Daout et al.
2001/0004582 A1 6/2001 Umeda et al.
2002/0074394 A1 6/2002 Birnie
2004/0029517 A1 2/2004 Perkitny
2004/0030622 A1 2/2004 Ramos et al.
2004/0188221 A1 9/2004 Carter
2005/0183927 A1 8/2005 Aas et al.

FOREIGN PATENT DOCUMENTS

CA 2299827 9/2001
DE 3 315 982 8/1988
DE 3 250 095 2/1995
DE 198 11 909 9/1999
EP 0 209 357 1/1987
EP 0 424 342 A2 4/1991
EP 0 493 127 12/1991
EP 0 409 809 3/1994
EP 0 615 643 7/1996
EP 0 831 431 3/1998
EP 0 729 624 B1 8/1998
EP 0 881 605 12/1998
EP 0 911 769 4/1999
EP 0 926 634 A2 6/1999
EP 0 986 031 A1 3/2000
EP 1 130 551 9/2001
EP 0 795 842 6/2002
EP 1 256 915 11/2002
EP 1 376 488 1/2004
EP 1 396 821 3/2004
EP 1 391 850 10/2004
EP 1 378 869 8/2005
EP 1 405 808 10/2005
EP 1 388 821 10/2006
EP 1 008 965 2/2007
EP 0 803 844 8/2007
EP 0 940 781 11/2007
FR 2 838 932 10/2003
GB 2 071 059 2/1980
GB 2 217 086 10/1989
GB 2 278 221 2/1997
GB 2 310 306 8/1997
GB 2 327 795 5/2001
GB 2 335 775 1/2002
GB 2 369 228 3/2004
JP 62-114092 5/1987
JP 64-31286 2/1989
JP 02-325397 11/1990
JP 03-156650 6/1991
JP 04205088 7/1992
JP 05006475 1/1993
JP 08-335287 12/1996
JP 11-269438 9/1999
JP 2001093019 4/2001
WO WO 90/09646 2/1990
WO WO 92/11953 7/1992
WO WO 93/10511 5/1993
WO WO 95/14290 5/1995
WO WO 96/36933 11/1996
WO WO 97/43739 11/1997

| | | |
|---|---|---|
| WO | WO 99/05624 | 2/1999 |
| WO | WO 00/31670 | 6/2000 |
| WO | WO 00/31694 | 6/2000 |
| WO | WO 00/31696 | 6/2000 |
| WO | WO 00/65546 | 11/2000 |
| WO | WO 00/67217 | 11/2000 |
| WO | WO 00/75766 | 12/2000 |
| WO | WO 01/04771 | 1/2001 |
| WO | WO 01/65493 | 9/2001 |
| WO | WO 02/082384 | 10/2002 |
| WO | WO 04/010367 | 1/2004 |
| WO | WO 04/070668 | 1/2004 |
| WO | WO 04/063065 | 7/2004 |
| WO | WO 04/070668 | 8/2004 |
| WO | WO 04/019285 | 3/2007 |
| WO | WO 2007/037744 | 4/2007 |
| WO | WO 2007/037745 | 4/2007 |
| WO | WO 2008/025429 | 3/2008 |

OTHER PUBLICATIONS

Ascom Twin Safe advertising brochure, Oct. 1999.
Bankinfo.com publication, May 2, 2001.
Ascom Twin Safe 2 advertising brochure.
IBM Technical Disclosure Bulletin vo. 15, No. 12, May 1973.
AST 9006, advertising brochure, 2001.
Cash Guard, advertising brochure.

* cited by examiner

APPARATUS FOR RECEIVING AND DISTRIBUTING CASH

CROSS-REFERENCE TO RELATED APPLICATIONS

This application is a divisional of U.S. patent application Ser. No. 10/025,336 filed Dec. 19, 2001, now U.S. Pat. No. 7,066,335, and is a continuation of U.S. patent application Ser. No. 11/111,588, filed Apr. 21, 2005 now abandoned, which application is a continuation of U.S. patent application Ser. No. 10/025,336. The entire disclosure of U.S. patent application Ser. No. 10/025,336 and the entire disclosure of U.S. patent application Ser. No. 11/111,588 are incorporated herein in their entirety by this reference.

FIELD OF THE INVENTION

The present invention relates to methods and systems for receiving and distributing cash. In particular, the present invention provides a novel apparatus for the inflow and outflow of a variety of cash.

BACKGROUND OF THE INVENTION

The use of automated cash systems such as automated teller machines (ATM) and other automated cash handling systems has become prevalent in the last several years. These systems are used for the deposit and withdrawal of cash, by tellers in banks, and to deposit and distribute currency in a retail setting.

A customer using an ATM will typically have a card or token with an identifying numerical sequence thereon that is inserted into the ATM, permitting the customer to deposit or withdraw funds from a bank account without interacting with a human teller. One substantial advantage of the ATM is the capability to transact bank business outside normal banking hours. A typical ATM will include a mechanism to dispense cash notes stored within the ATM in response to a customer's request. In order to maintain an accurate record of the customer's account, many ATMs also include a mechanism to detect and count cash notes dispensed. However, many ATMs do not include a mechanism to count and confirm deposited cash. In addition, many ATMs do not include mechanisms to recycle and dispense deposited cash.

Other types of automated banking machines are used to count and dispense cash. These machines are often used by tellers or customer service representatives in banking and other transaction environments. Other automated distribution systems are used in retail settings (e.g., to give change to customers making purchases with cash).

Automated cash machines are typically used in retail and bank settings where space is at a premium. Most currently available systems are large and take up considerable space. What is needed is a cost-effective, small profile system with cash recycling capabilities.

DESCRIPTION OF THE FIGURES

The following figures form part of the present specification and are included to further demonstrate certain aspects and embodiments of the present invention. The invention may be better understood by reference to one or more of these figures in combination with the detailed description of specific embodiments presented herein.

SUMMARY OF THE INVENTION

Figure 1:
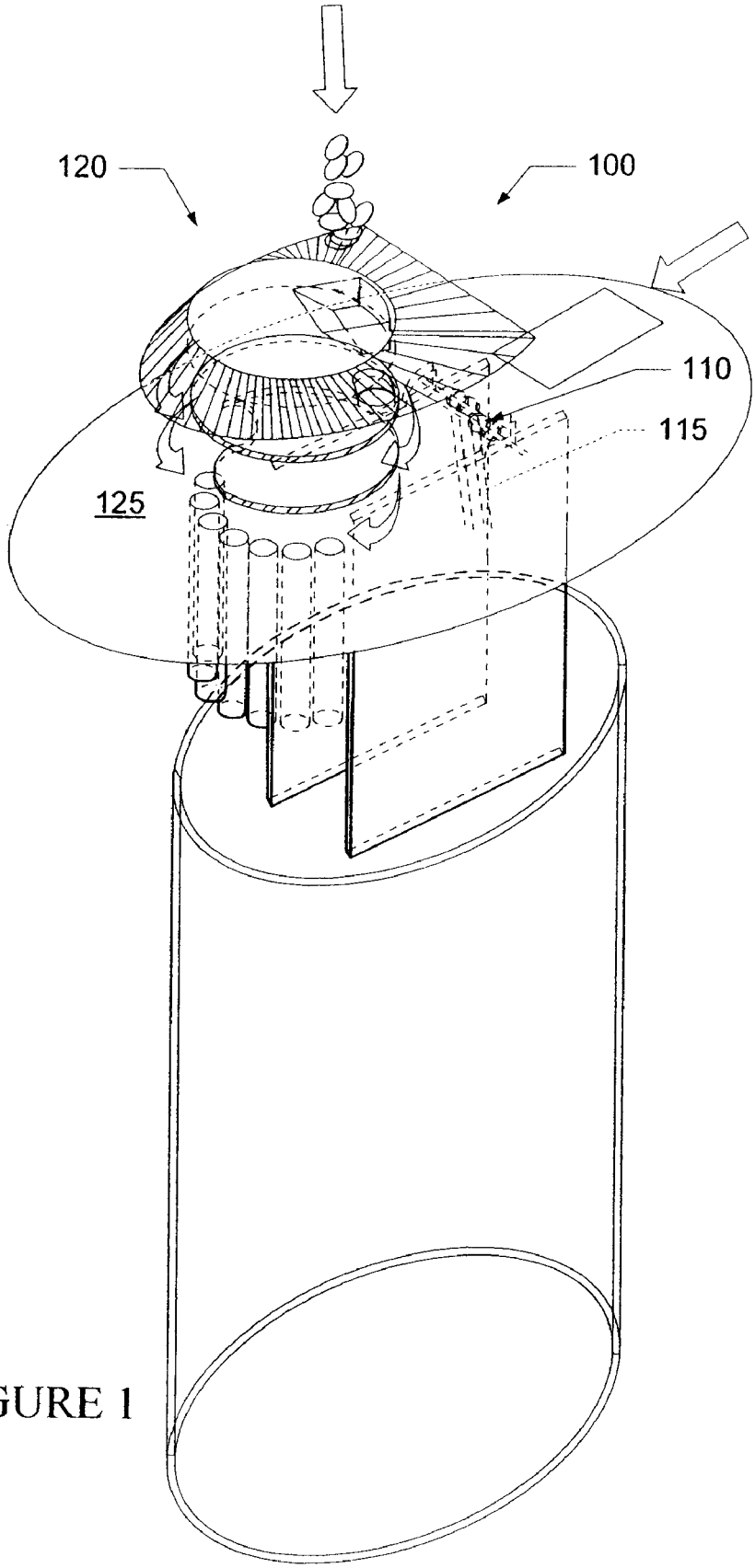
FIG. 1 shows an expanded view of the apparatus of the present invention.

The present invention relates to methods and systems for receiving and distributing cash. In particular, the present invention provides a novel apparatus for the inflow and outflow of a variety of cash.

Accordingly, the present invention provides an apparatus comprising a system configured to direct inflow and outflow of input coins and notes, wherein the system automatically separates input coins and notes into different denominations and wherein the system reuses the input coins and notes as the output coins and notes. In some embodiments, the coins and notes comprise coins and notes issued by greater than one country. In some embodiments, the coins and notes comprise coins and notes of greater than one denomination. In other embodiments, the coins and notes comprises cash of greater than four denominations. In some embodiments, the system further comprises a single slot for the inflow and/or outflow of notes. In some preferred embodiments, the apparatus is less than 6 cubic feet in volume, and more preferably less than 2 cubic feet in volume. In some embodiments, the system is oriented in a countertop so that during the process of inflow, storage, and outflow, the notes and/or coins move through a countertop. The present invention is not limited to passage through any particular countertop. Indeed, passage through a variety of countertops is contemplated including bank, grocery, retail store, and service station countertops. In some embodiments, the apparatus further comprises a transport belt component in communication with the notes, wherein the transport belt component is configured to receive and deliver notes; and at least one note storage component in communication with the transport belt component, wherein the note storage component is configured to receive notes from the transport belt component and dispense notes to the transport belt component. In some embodiments, the apparatus further comprises coin and/or note detection components configured to identify and confirm the integrity of the coins and notes input into the apparatus; and in other preferred embodiments one or more note direction changer components operably linked to the transport belt component and the notes storage component, wherein the note direction changer component is configured to direct notes into and out or past each of the note storage components. In some embodiments, the apparatus further comprises a user interface terminal. In some embodiments, the apparatus further comprises a single motor operably linked to the transport belt component, wherein the motor is configured to drive the transport belt component. In some embodiments, the note detection component is a magnetic sensor, wherein the magnetic sensor further comprises an integrated software element. In some embodiments, the integrated software element further comprises a circuit board. In some embodiments, the apparatus is configured for the simultaneous input of coins of greater than four denominations. In some embodiments, the apparatus further comprises a pipe-shaped cover, the cover covering the entire apparatus. In some embodiments, the apparatus further comprises one or more coin storage components in communication with an upper rotating disk and a lower rotating disk, wherein the upper rotating disk and lower rotating disk are configured to direct coins into and out of the coin storage component. In some embodiments, the apparatus further comprises a coin receiving unit in communication with the upper rotating disk, wherein the coin receiving unit is configured for the input and output of coins. In some embodiments, the apparatus further comprises a coin detection component in communication with the main upper rotating disk.

The present invention further provides an apparatus for the inflow and outflow of coins and notes comprising a system for receiving and distributing coins and notes, wherein the apparatus comprises both a note handling system and coin handling system and wherein the apparatus is less than 6 cubic feet in volume. In some embodiments, the coins and notes comprise coins and notes issued by greater than one country. In some embodiments, the coins and notes comprise coins and notes of greater than four denominations. In some embodiments, the apparatus further comprises a single slot for the inflow and outflow of notes, and a single coin receiving unit for the infeed and outfeed of coins. In some embodiments, during the process of inflow, storage, and outflow, the notes and/or coins move through a countertop. In some embodiments, the apparatus further comprises a transport belt component in communication with the notes, wherein the transport belt component is configured to receive and deliver notes; and at least one note storage component in communication with the transport belt component, wherein the note storage component is configured to receive notes from the transport belt component and dispense notes to the transport belt component. In some embodiments, the apparatus further comprises a note detection component configured to identify and confirm the integrity of the notes input into the apparatus; and in additional preferred embodiments one or more note direction changer components operably linked to the transport belt component and the note storage component, wherein the note direction changer component is configured to direct notes into and out or past each of the cash storage components. In some embodiments, the apparatus further comprises a user interface terminal. In some embodiments, the apparatus further comprises a single motor operably linked to the transport belt component, wherein the motor is configured to drive the transport belt component. In some embodiments, the note detection component is a magnetic sensor, wherein the magnetic sensor further comprises an integrated software element. In some embodiments, the integrated software element further comprises a circuit board. In some embodiments, the note storage component is a film storage drum. In some embodiments, the film storage drum is configured to hold at least 100 notes. In some embodiments, the note direction changer component is a note direction changer wheel.

The present invention additionally provides an apparatus for the inflow and outflow of notes comprising a single slot configured for the inflow and outflow of different denominations of the notes. In some embodiments, the apparatus further comprises a transport belt component in communication with the single slot, wherein the transport belt component is configured to receive and deliver the notes to the slot; and at least one note storage component operable linked to the transport belt component, wherein the note storage component is configured to receive notes from the transport belt component and dispense notes to the transport belt component. In some embodiments, the apparatus further comprises a note detection component configured to identify and confirm the integrity of the notes input into the single slot; and one or more note direction changer components in communication with the transport belt component and the storage component, wherein the note direction changer component is configured to direct notes into and out of or past each of the note storage components. In some embodiments, the notes comprises notes issued by greater than one country. In some embodiments, the apparatus further comprises a user interface terminal.

The present invention also provides an apparatus for the inflow or outflow of notes, the apparatus comprising one or more note direction changer wheels configured to change the flow direction of the notes. In some embodiments, the apparatus further comprises a single slot for the inflow or outflow of the notes. In some embodiments, the apparatus further comprises a transport belt component in communication with the notes, wherein the transport belt component is configured to receive and deliver notes; and at least one note storage component in communication with the transport belt component, wherein the note storage component is configured to receive notes from the transport belt component and dispense notes to the transport belt component. In some embodiments, the apparatus further comprises a note detection component configured to identify and confirm the integrity of the notes. In some embodiments, the notes comprises notes issued by greater than one country. In some embodiments, the notes comprise notes of greater than four denominations. In some embodiments, the apparatus further comprises a user interface terminal.

In still further embodiments, the present invention provides an apparatus for the inflow of notes, the apparatus comprising a magnetic detection component configured to detect the denomination of the notes. In some embodiments, the apparatus further comprises a single slot for the inflow and outflow of notes. In some embodiments, the apparatus further comprises a transport belt component in communication with the notes, wherein the transport belt component is configured to receive and deliver the notes; and at least one note storage component in communication with the transport belt component, wherein the note storage component is configured to receive notes from the transport belt component and dispense notes to the transport belt component. In some embodiments, the apparatus further comprises one or more note direction changer components in communication with the transport belt component and the note storage component, wherein the note direction changer component is configured to direct notes into and out of or past each of the note storage components. In some embodiments, the notes comprise notes issued by greater than one country. In some embodiments, the notes comprise notes of greater than four denominations.

In additional embodiments, the present invention provides a system for infeeding and outfeeding notes and coins, comprising a single note infeed opening configured for the inflow and/or outflow of notes of different denominations into said system; a single coin infeed opening for the input and/or output of coins of different denominations into said system; at least one note detection component configured to identify and confirm the integrity of the notes; at least one coin detection component configured to identify and confirm the integrity of the coins; at least one note storage component; at least one coin storage component; note movement components for moving notes between said note infeed opening and the at least one note storage component; coin movement components for moving coins between the coin infeed opening and said at least one coin storage component; at least one automatic separation component for separating notes into different denominations; and at least one automatic separation component for separating coins into different denominations. In some embodiments, the system is less than 6 cubic feet in volume. In some embodiments, the notes and coins comprise notes and coins issued by greater than one country. In some embodiments, the notes and coins comprise notes and coins of greater than four denominations. In some embodiments, the system further comprises a user interface terminal. In some embodiments, said notes and coins in the process of inflow, storage and outflow move through a countertop. In still further embodiments, outflow of notes occurs through the note infeed open. In still other embodiments, coin outfeed occurs through the coin infeed opening.

In further preferred embodiments, the present invention provides methods for facilitating the input and output of notes to a customer or other user, comprising providing a system for inflow and outflow of notes and coins, comprising a single note infeed opening for inflow of different denominations of notes into the system; a single coin infeed opening for inflow of different denominations of coins into the system; at least one note detection component configured to identify and confirm the integrity of the notes; at least one coin detection component configured to identify and confirm the integrity of the coins; at least one note storage component; at least one coin storage component, note movement components for moving notes between the note infeed opening and the at least one note storage component; coin movement components for moving coins between the coin infeed opening and the at least one coin storage component; at least one automatic separation component for separating notes into different denominations; and at least one automatic separation component for separating coins into different denominations; and infeeding the notes through said slot. In some embodiments, the notes comprise notes issued by greater than one country. In further preferred embodiments, the notes comprise notes of greater than four denominations. In still further preferred embodiments, the coins comprise coins of greater than four denominations. In other embodiments, the system is less than 6 cubic feet in volume. In some preferred embodiments, the notes and coins in the process of inflow, storage, and outflow move through a countertop. In still other embodiments, the outflow of notes occurs through said note infeed opening. In still further embodiments, the outflow of coins occurs through said coin infeed opening. In some preferred embodiments, the system further comprises a transport belt component in communication with the notes, wherein the transport belt component is configured to receive and deliver notes; the at least one note storage component in communication with the transport belt component, wherein the note storage component is configured to receive notes from the transport belt component and dispense notes to the transport belt component. In other embodiments, the note storage component is a film storage drum. In still other embodiments, the system further comprises a note detection changer component, wherein the note direction changer component is a note direction changer wheel.

In further preferred embodiments, the present invention provides methods for facilitating infeeding and outfeeding notes of notes to a customer comprising providing a notes input and output system having a notes storage component; accepting input of notes into the system under conditions such that the input notes are stored; and outfeeding at least a portion of input notes so that input notes are reused as output notes. In other embodiments, the system comprises a single slot for the input and output of the notes. In still other embodiments, the single slot for the input and output of the notes is in communication with a single belt for input and output of the notes. In some preferred embodiments, the notes comprise notes issued by greater than one country. In other embodiments, the notes comprise notes of greater than one denomination.

In still other embodiments of the present invention, methods for facilitating the inflow or outflow of coins from and to a customer are provided, wherein the methods comprising providing an apparatus comprising a first planar member having a hole therein, wherein the hole is configured to accept at least one coin; a second planar member having a cutout therein, wherein the cutout is configured to accept at least one coin; and at least one coin storage unit; wherein the first and second planar members are each movable between at least first and second positions, wherein in the first position the second planar member forms a floor for the hole in the first member and wherein in the second position the hole in the first planar member and the cutout in the second planar member align so that a coin contained in the hole in the first planar member travels through the cutout in the second planar member into the at least one coin storage unit; and accepting infeed of said coins through said coin cup. In preferred embodiments, the methods further comprise the step of confirming the identity of said coins with a coin detection component in communication with the first planar member. In still further preferred embodiments, the coins comprise coins issued by greater than one country. In other preferred embodiments, the coins comprise coins of greater than one denomination.

In still further embodiments, the present invention provides an apparatus comprising a system for processing coins, wherein the system separates input coins into different denominations and reuses the input coins as output coins, and wherein a last input coin of a denomination is fed out as the first coin of that denomination. In further embodiments, the system comprises a coin detection device, wherein the coins are moved horizontally past the coin detection device by the system. In preferred embodiments, the system comprises a first planar member and the coins are moved past the coin detection device by the planar member. In further preferred embodiments, the system comprises a second planar member and at least one coin storage compartment and the coins are transported to the coin storage compartment by the first and second planar members. In other preferred embodiments, the planar members rotate. In some preferred embodiments, the planar members rotate about a common axis, wherein the axis is in vertical orientation, and the planar members are in horizontal orientation. In particularly preferred embodiments, the system comprises two or less planar members. In further embodiments, the first and second planar members comprise at least one opening and the coins are moved in a horizontal position when located in the one or more openings. In preferred embodiments, the one or more openings are configured to contain one coin at a time. In some embodiments, during the process of outfeeding coins, the second planar member separates the coins one by one from the coin storage compartment and transports the coins to an outfeed opening. In still further embodiments, the outfed coins are presented as a standing pile of coins. In other embodiments, the coins comprise coins issued by greater than one country. In still further preferred embodiments, the coins comprise coins of greater than four denominations. In some embodiments, the system further comprises a single opening for the inflow and outflow of the coins. In further embodiments, the apparatus is less than 3 cubic feet in volume. In some other embodiments, the system is configured in a countertop so that coins move through an opening in a countertop during the processes of inflow and storage, feedout from storage and output of coins to the user. In still further preferred embodiments, the coins are stored lying on top of each other in the coin storage compartment. In still other preferred embodiments, the first planar member is positioned above the second planar member so that by moving the second planar member so that the opening of the second planar member is aligned with the opening in the first planar member the coins fall from the first planar member into or through the second planar member. In other preferred embodiments, the first planar member has an opening therein and further comprises a movable floor beneath the first planar member, movement of the movable floor causing the coins to fall from the first planar member into or through the floor. In some embodiments, the coins move less than 8 inches vertically from infeed to entrance into the storage compartment.

In other preferred embodiments, the present invention provides a system for inflow and outflow of coins, wherein the system separates input coins into different denominations and reuses the input coins as the output coins, comprising: a) a single coin infeed opening for receiving a plurality of coins; b) a first rotating planar member for separating input coins from the coin infeed opening, the rotating planar member having at least one opening therein configured to accept one coin so that coins are removed from the coin infeed opening by being located in the at least one opening; c)a coin detection device adjacent to the rotating planar member, wherein the rotating planar member moves the coins past the detection device; d) at least one coin storage compartment; and e) a single coin outfeed opening for outfeeding different denominations of coins; wherein the last input coin of a denomination is fed out as the first coin of that denomination from the coin storage compartment.

In some other embodiments, the present invention provides an apparatus for processing coins comprising a horizontally moving planar member configured to transport coins, wherein the horizontally moving planar member facilitates separation of input coins into different denominations, reuse of the input coins as output coins, separation of coins from an input batch, movement of coins past a coin detection unit, and transport to a storage.

In further preferred embodiments, the present invention provides an apparatus for processing coins by separation of input coins into different denominations comprising a first horizontally moving planar member, a second horizontally moving planar member that rotates about a common axis with the first horizontally moving planar member, a coin detection device, and at least one coin storage compartment, wherein coins are moved past the coin detection device by rotational movement of the first or second horizontally moving planar members and wherein coins are transported to the storage compartment by the rotational movement of the first and second horizontally moving planar members.

In other preferred embodiments, the present invention provides methods for facilitating handling of coins comprising: a) providing a system for processing coins by separation of input coins into different denominations comprising: i) a first horizontally moving planar member; ii) a second horizontally moving planar member that rotates about a common axis with the first horizontally moving planar member; iii) a coin detection device; iv) and at least one coin storage compartment; wherein coins are moved past the coin detection device by rotational movement of the first or second horizontally moving planar members and wherein coins are transported to the storage compartment by the rotational movement of the first and second horizontally moving planar members; and b) accepting infeed of the coins. In some embodiments, the system further comprises an opening for the inflow of coins configured to accept a plurality of coins. In other embodiments, the system further comprises a single opening for the inflow and outflow of coins. In preferred embodiments, the coins comprise coins of greater than four denominations. In other preferred embodiments, the system comprises at least four of the coin storage compartments. In still other preferred embodiments, the system is configured in a countertop so that coins move through an opening in a countertop during the process of inflow and storage.

In still other preferred embodiments, the present invention provides an apparatus for processing coins comprising: a first planar member having a hole therein, wherein the hole is configured to accept at least one coin; a second planar member having a cutout therein, wherein the cutout is configured to accept at least one coin; and at least one coin storage unit; wherein the first and second planar members are each movable between at least first and second positions, wherein in the first position the second planar member forms a floor for the hole in the first member and wherein in the second position the hole in the first planar member and the cutout in the second planar member align so that a coin contained in the hole in the first planar member travels through the cutout in the second planar member into the at least one coin storage unit. In some embodiments, the first and the second planar members are disk-shaped. In other embodiments, the first and the second planar members rotate about a common axis. In further preferred embodiments, the axis is a vertical axis and the first and second planar members are in a horizontal orientation. In other preferred embodiments, the at least one coin storage unit is tube shaped. In some embodiments, the apparatus further comprises a plurality of coin storage units for different denominations of coins, wherein the first and second planar members are movable between a plurality of positions to align the hole in the first planar member with the cutout in the second planar member with the plurality of coin storage units. In preferred embodiments, the coins are transported in a horizontal orientation. In still further preferred embodiments, the coins are stored in the at least one coin storage unit in a horizontal orientation. In some embodiments, the apparatus comprises a coin detection unit. In still other embodiments, the first planar member horizontally moves coins past the coin detection unit.

In other embodiments, the present invention provides an apparatus for the inflow and outflow of coins comprising: a coin receiving member for receiving a plurality of coins, the coin receiving member having an opening therein; a first planar member having a hole therein, wherein the hole is configured to accept at least one coin and wherein the first planar member is movable between at least first and second positions, wherein in the first position the first planar member forms a floor for the opening in the coin receiving member and in the second position the hole in the first planar member aligns with the opening, and further wherein the movement between the first and the second positions causes one coin to be accepted into the hole; coin detection unit, wherein the first planar member moves the coins past the coin detection unit; second planar member having a cutout therein, wherein the cutout is configured to accept at least one coin, the second planar member movable between at least first and second positions, wherein in the first position the second planar member forms a floor for the hole in the first planar member; t least one coin storage unit, wherein the first and second planar members are movable to align the hole in the first planar member and the cutout in the second planar member align so that a coin contained in the hole in the first planar member travels through the cutout in the second planar member into the at least one coin storage unit; a coin storage unit motor for expelling coins from the coin storage unit through the cutout in the second planar member into the hole in the first planar member; coin outfeed unit in communication with the coin receiving member, the first planar member movable to a position wherein the coin in the hole is deposited into the coin outfeed unit; and motor in the coin outfeed unit for expelling coins collected in the coin outfeed unit into the coin receiving member.

Definitions

To facilitate understanding of the invention, a number of terms and phrases are defined below:

As used herein, the term "user interface terminal" refers to a terminal (e.g., a computer screen and a computer processor) functionally linked to a cash handling system of the present invention. Such terminals are used for communication with users (e.g., for inputting the value of cash deposited or withdrawn) and other systems (e.g., central communications servers or other cash distribution systems). In some embodiments, communication occurs over the Internet. Consequently, some user terminals further comprise web servers.

As used herein, the terms "computer memory" and "computer memory device" refer to any storage media readable by a computer processor. Examples of computer memory include, but are not limited to, RAM, ROM, computer chips, digital video disc (DVDs), compact discs (CDs), hard disk drives (HDD), and magnetic tape.

As used herein, the term "computer readable medium" refers to any device or system for storing and providing information (e.g., data and instructions) to a computer processor. Examples of computer readable media include, but are not limited to, DVDs, CDs, hard disk drives, magnetic tape and servers.

As used herein, the terms "processor" and "central processing unit" or "CPU" are used interchangeably and refers to a device that is able to read a program from a computer memory (e.g., ROM or other computer memory) and perform a set of steps according to the program.

As used herein, the terms "money" refers to any medium which can be exchanged for something of value. Examples of money include, but are not limited to, notes, coins, money orders, and cashier checks.

As used herein, the term "cash" refers to notes and coins.

As used herein, the term "denominations" refers to notes and coins of different value (e.g., one dollar, five dollar, quarters, dimes, etc.).

As used herein, the term "currencies" refers to money of different countries (e.g., euros, pounds, pesos, kroner, francs, dollars, etc.).

As used herein, the term "notes" refers to paper money.

As used herein, the term "coins" refers to metal money.

GENERAL DESCRIPTION OF THE INVENTION

The present invention relates to methods and systems for receiving and distributing cash. In particular, the present invention provides a novel apparatus for the inflow and outflow of a variety of cash. Currently available systems for the inflow and outflow of cash have several disadvantages relative to the systems of the present invention.

For example, the Cross International HT 8000 (Cross International Technologies) is able to accept multiple denominations of notes but recycle only one denomination of notes and is relatively expensive ($50,000).

THE FACT—Asp (Fujitsu ICL Financial Services Division) is able to accept six denominations of coins and three denominations of notes but is only able to recycle two note denominations. Diebold markets the CashSource Plus 400P. This is primarily a cash dispenser, where the merchants may refill the unit themselves with in-store-cash.

CashGuard makes a product that recycles notes and coins. However, the user must sort the notes into different slots in the machine by hand. The users may also feed in only one coin at the time, as opposed to inputting a batch of coins that are automatically separated and sorted. De La Rue makes the TwinSafe II system. This unit recycles notes up to 8 different denominations, but is not capable of handling coins.

In contrast, the cash handling system of the present invention is able to accept and recycle multiple denominations of cash (e.g., notes and coins), as well as currencies from multiple countries. The apparatus is much easier to use, due to the combination of both coin and note recycling, and the through the countertop operation procedure. Novel design features result in an apparatus that is less than 30% of the size of currently available apparatus. Such an apparatus is uniquely suited for a variety of retail, public, and banking settings.

Accordingly, in some embodiments, the present invention provides automated cash handling apparatuses, systems, and methods for the intake and output of cash documents (e.g., notes and coins). In some preferred embodiments, the apparatus is smaller than those currently available. In other embodiments, the apparatus contains a single cash transport belt system driven by a single motor, providing the advantage of using the same slot for the input and output of cash. In still other embodiments, the apparatus includes a single magnetic sensor controlled by an integrated software program. In yet other embodiments, the apparatus includes foam rubber drums for changing the direction of notes. The automated cash handling systems and methods of the present invention thus provide multiple points of novelty as well as advantages in efficiency of use.

DETAILED DESCRIPTION OF THE INVENTION

A. Cash Handling Apparatus

FIGS. 1-4 show the cash handling unit of the present invention. Referring to FIG. 1, an apparatus 100 of the present invention is a generally cylindrical or pipe-shaped apparatus. The apparatus comprises a slot 110 for the inflow and outflow of notes and a transport belt component 115 (not shown in its entirety, refer to FIG. 2 below for an schematic depiction). The apparatus further comprises a note detection component (not shown in FIG. 1) configured to confirm the integrity and value of deposited notes. The apparatus additionally comprises a note direction changer component (not shown in FIG. 1) configured to direct notes into, out of, or past one or more note storage components (not shown in FIG. 1). In further preferred embodiments, the apparatus 100 further comprises a coin recycling unit 120 for providing inflow and outflow of coins from the apparatus 100. The apparatus 100 further comprises an upper surface 125, which in preferred embodiments can be a countertop as described in more detail below.

Figure 2:
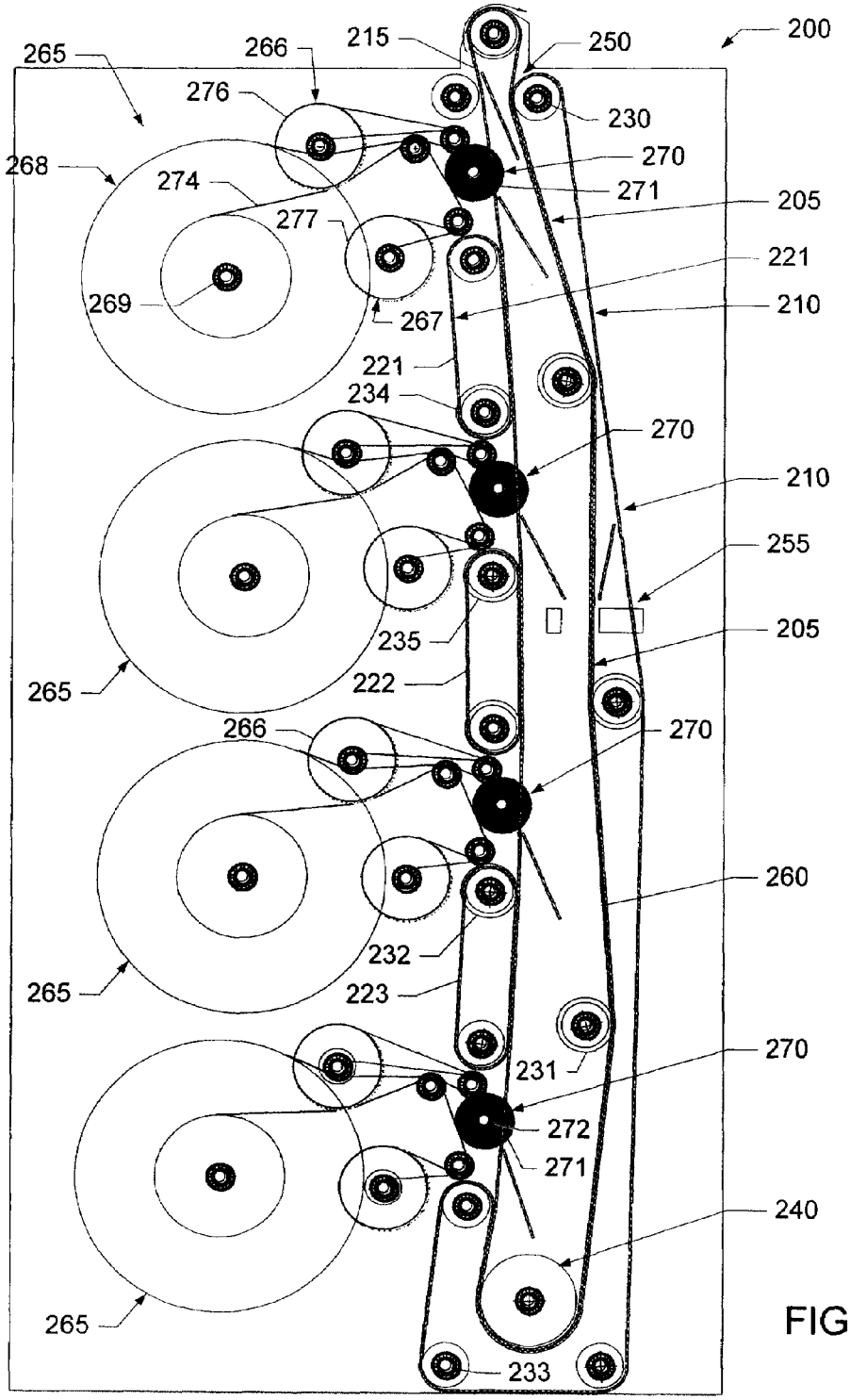
FIG. 2 shows a detailed schematic of the note processing portion of an apparatus of some embodiments of the present invention.

FIG. 2 provides a detailed view of preferred embodiments of the apparatus of the present invention. The cash handling apparatus 100 of the present invention comprises a single transport belt component 200 for the transport of notes. The transport belt component 200 provides a single track 205 for the transport of notes. The transport belt component 200 comprises five coacting belts 210, 215, 221, 222 and 223. Notes are held between the belts 210, 215, 221, 222 and 223 as they are moved along the belt transport component 200. The belts 210, 215, 221, 222, and 223 are comprised of any suitable material, including but not limited, to rubber. The transport belt component 200 is controlled by a plurality of crowned wheel/belt pulleys (e.g., 230, 231, 232, 233, 234, and 235) and is driven by a wheel 240.

Figure 3:
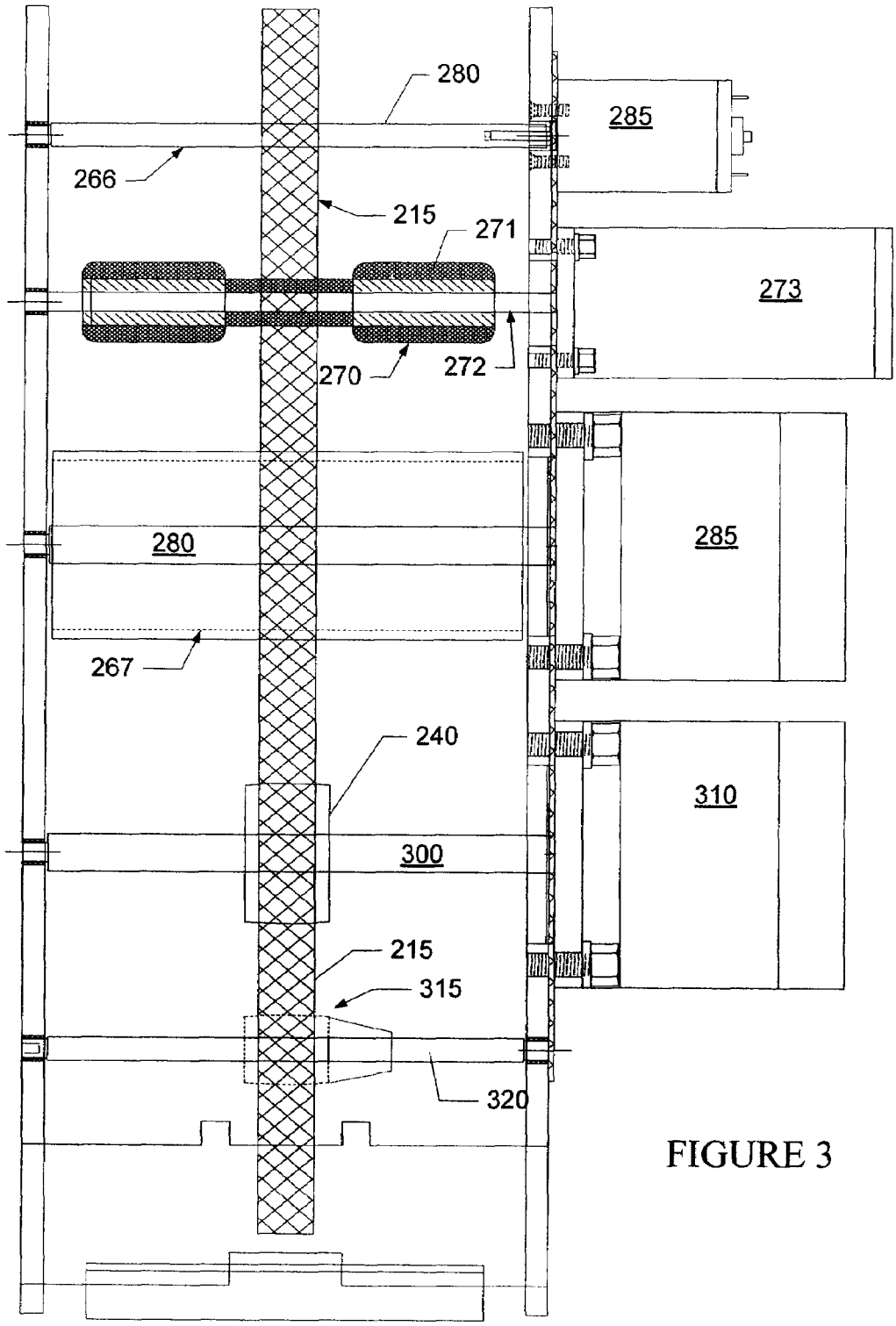
FIG. 3 shows an expanded view of the note belt transport and motor of an apparatus of the present invention.

FIG. 3 shows a side view of the motor and wheel assembly of an apparatus of the present invention. The wheel 240 (i.e., a driving belt pulley), which is preferably steel or plastic, contains a shaft 300 (preferably steel or plastic). A motor 310 turns the shaft 300, which turns the wheel 240, thus driving the movement of the transport belt 215. The present invention is not limited to the use of any particular motor. Any suitable motor may be utilized, including but not limited to, those manufactured by Sonceboz and Mabuchi. The crowned wheel/belt pulley 315 contains a shaft 320 to allow for the crowned wheel to turn. As can also be seen, a wheel 272 (preferably made of rubber) is turned by the shaft 271, which is driven by the motor 273.

Referring back to FIG. 2, the crowned wheel/belt pulleys (e.g. 230, 231, 232, 233, 234, and 235) direct the transport belt component 200. The belts 221, 222, and 223, also turn on crowned wheel/belt pulley assemblies (e.g., 235). The belts 221, 222 and 223 also serve to direct the belt transport component 200.

Still referring back to FIG. 2, notes are deposited through the single opening 250 and travel along the transport belt component 200 to a detection component 255. An example of a note 260 between the two coacting belts 210 and 215 is shown in FIG. 2. The present invention is not limited to any particular detection component. Any suitable detection component may be utilized in the apparatus of the present invention. In some embodiments, the detection component 255 is a magnetic sensor (e.g., including but not limited to, magnetic sensors similar to those described in U.S. Pat. Nos. 5,960,103 and 6,047,886; each of which is herein incorporated by reference). In some embodiments, the magnetic sensor is controlled by computer software and a computer processor. In some preferred embodiments, the computer processor and software are integrated with the cash handling apparatus via an integrated circuit board (i.e., the same software controls the apparatus also controls the magnetic sensor).

In other embodiments, the detection component is similar to the bill testing arrangement described in U.S. Pat. Nos. 5,975,273 and 5,533,627 (herein incorporated by reference) are utilized to determine the authenticity and value of deposited notes. In still other embodiments, the detection component is similar to the sensor unit described in U.S. Pat. No. 6,074,081 (herein incorporated by reference). In yet other embodiments, the detection component is similar to the illumination device and sensor described in U.S. Pat. No. 6,061,121 (herein incorporated by reference). In still further embodiments, the detection component is similar to the detector described in U.S. Pat. Nos. 6,101,266 and 5,923,413 (herein incorporated by reference) or the document sensor described in U.S. Pat. No. 6,241,244 (herein incorporated by reference).

Counterfeit notes are returned to the user. In some embodiments, the user is also given a confirmation (e.g., on a user interface terminal or via a printed receipt) of the amount of cash to be deposited.

Following confirmation of the integrity (e.g., whether or not the note is counterfeit) and value of the deposited notes, notes are directed further down the transport belt to one of a plurality (e.g., 4) of storage components 265. One of the storage components will now be described in more detail. Notes are directed into a storage component 265 via a note direction changer component 270. In some embodiments, the note direction changer component 270 comprises a wheel 271 (made of rubber in some preferred embodiments) and a shaft 272 driven by a motor 273. The direction of notes is changed by turning the currency around the wheel 271. To deposit notes into the storage component 265, the wheel 271 is turned in the opposite direction of the main belt 210.

The present invention is not limited to the note direction changer component described above. Indeed, the present invention encompasses any component configured to direct cash (e.g., notes and coins) into and out of storage component 265, including but not limited to, the path selector mechanism described in U.S. Pat. No. 5,680,935 and the gate mechanisms described in U.S. Pat. Nos. 6,109,522 and 6,170,818 (each of which is herein incorporated by reference).

In some embodiments, the storage component 265 comprises first 266 and second 267 film storage drums and note storage drum 268. As notes are transported into the storage component 265, they are encased between first 276 and second 277 sheets of plastic film or foil or any other suitable material. The first 276 and second 277 sheets of plastic film are spooled on the first 266 and second 267 film storage drums, respectively. The plastic film 274 encasing the notes is wound around the shaft 269 in the note storage drum 268 until the drum is full. Each film storage drum 266 and 267 contains a shaft (e.g., comprised of steel) 280 driven by a motor 285 (See FIG. 3). In some embodiments, the note storage drum 268 is capable of holding at least 100 notes. Each note storage drum 268 holds one or more types of notes. In some embodiments, greater than one of the drums 268 holds the same type of cash. For example, a more commonly deposited denomination may be contained on two or more drums and a less commonly deposited denomination or type of cash may be contained on only one drum. The amount of notes and note identifying information (e.g., value and issuing country) stored on each note storage drum is stored in memory by the integrated software element.

The present invention is not limited to the storage components described above. Indeed, the present invention contemplates a variety of storage components, including but not limited to, the drums, cassettes and other storage components described in U.S. Pat. Nos. 5,064,074, 5,628,258, 5,533,627 and PCT publication WO 00/31694; each of which is herein incorporated by reference.

The apparatus of the present invention is configured to recycle deposited cash from all of the storage components 265. When a user wishes to withdraw cash or change is given, the amount to be dispersed is relayed to the cash handling apparatus (e.g., via a user interface terminal and keypad or automated). Cash is removed from one or more (depending on the value and identity of the cash to be dispersed) storage components 265 using the motor 285 connected to the storage component 265 and the motor 273. connected to the currency direction changer component 270. The motor 285 is reversed and notes are spooled out of the drum 265. In embodiments utilizing the cash direction changer wheel 271 shown in FIG. 2, the wheel 271 is reversed (i.e., it is turned in the opposite direction of the main belt) by the shaft 272 and the motor 273. Cash is spooled out of the plastic film/foil 274 and onto the belt component 205. Cash is then transported along belt 215 and out the opening 250. In some embodiments, the user is then provided with a receipt indicating the value of the dispensed cash.

Figure 4:
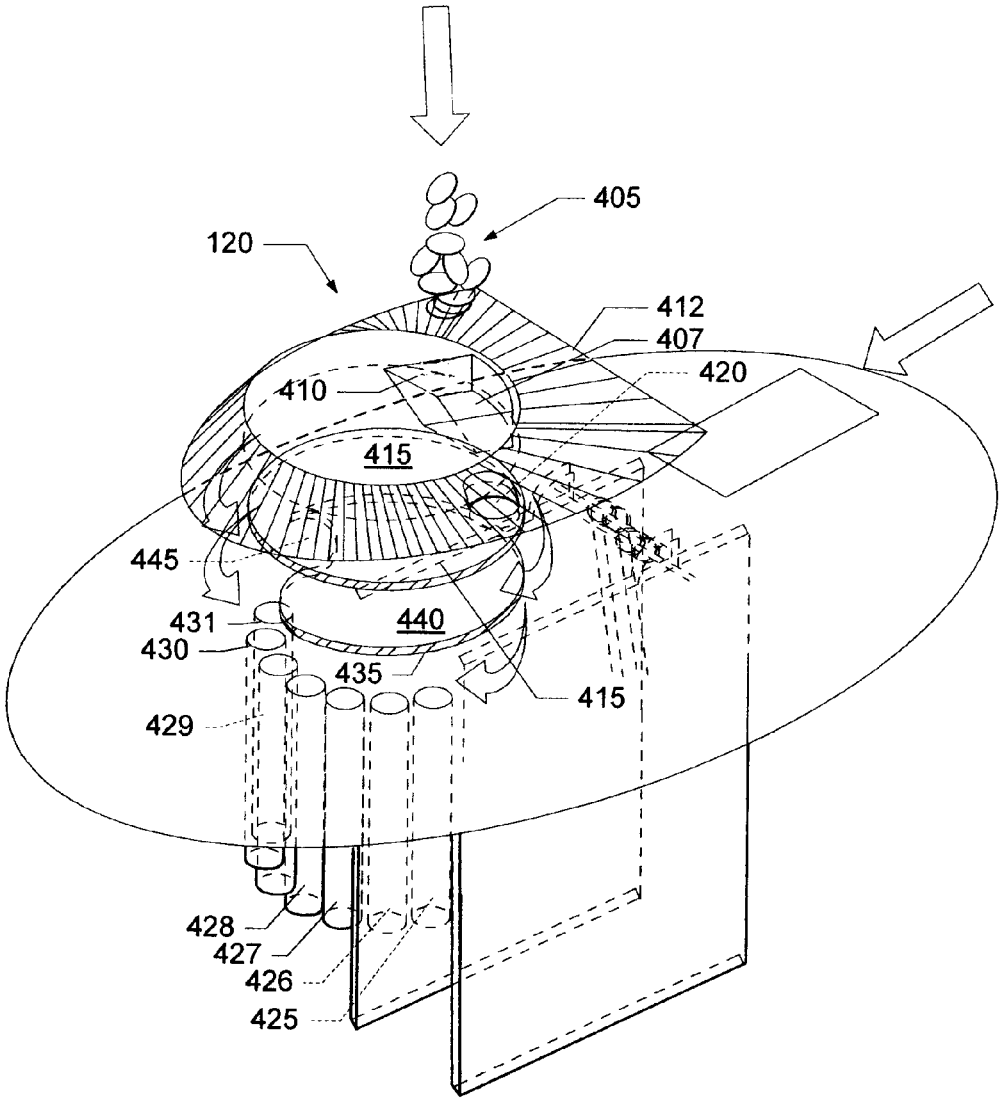
FIG. 4 shows an expanded view of the apparatus of the present invention comprising a view of the coin processing portion of the apparatus connected to the note processing portion of the apparatus.

The cash handling apparatus of the present invention is also configured for the in and outfeed of coins. FIG. 4 shows a view of the coin recycling unit 120 of the apparatus. All coins 405 are deposited in the coin receiving unit 410 in the cover 412. In preferred embodiments, the coin receiving unit 410 is generally cup-shaped. The bottom of the coin receiving unit 410 has therein an opening 407. An upper rotating planar member, preferably an upper rotating planar disk 415 forms a floor for the coin receiving unit 410 and rotates about an axis (not shown). The upper rotating disk 415 has therein a hole 420 therein for receiving coins. In preferred embodiments, the hole 420 is generally, but not limited to a circular shape. Coins are separated by gliding one at the time into the hole 420 in the rotating disk 415. The upper rotating disk 415 is preferably designed so that only one coin at a time is removed from the opening 407 in the coin receiving unit 410. The coin is then transported by the upper rotating disk 415 past a sensor (not shown) that identifies the coins and causes the coins to be sorted. In preferred embodiments, the sensor is a magnetic sensor and the coin is transported along its horizontal plane to the sensor. The coin is then transported by the rotating disk 415 to a position directly above one of a plurality of storage compartments e.g., 426, 427, 428, 429, 430, and 431. An apparatus of the present invention may comprise one or more storage compartments. Preferably, the coin is also kept in a horizontal orientation for this step.

The apparatus further comprises a lower rotating disk 435 having an upper surface 440 and having therein a cutout 445. In preferred embodiments, the upper rotating disk 415 and lower rotating disk 435 rotate about the same axis. In preferred embodiments, the cutout 445 is generally circular in shape. The lower rotating disk 435, the upper surface 440 of which functions as a floor for the hole 420 in the upper rotating disk 415, rotates so that the cutout aligns with the hole 420 in the upper rotating disk 415 to open a passage to a preselected (i.e., by the coin detection component) storage compartment, 426, 427, 428, 429, 430, or 431. The upper rotating disk 415 and lower rotating disk 435 then rotate into new positions, ready to receive or feed out new coins.

In order to outfeed coins, the coins are lifted by a motor (not shown) from a storage compartment, 426, 427, 428, 429, 430, or 431, through the cutout 445 in the lower rotating disk 435 and placed into the hole 420 in the upper rotating disk 415. Preferably, the hole 420 is configured so as to accept only a single coin. The upper rotating disk 415 then rotates, with the coin positioned in the hole 420, until the coin is deposited in the coin outfeed tube 425. In preferred embodiments, all of the coins that are to be outfed during a particular transaction are accumulated into the outfeed tube 425 prior to deposit into the coin receiving unit 410. A motor (not shown) caused the coin(s) to be transported out into the coin receiving unit 410. In preferred embodiments, the coin processing component of the apparatus communicates with the note processing component.

The cash handling apparatus of the present invention is configured for the deposit and recycling of a variety of currencies and denominations. Unique design features including a single transport belt component 215, single magnetic sensor component 255, note direction changer 270 and a single opening 250, minimize the size of the apparatus. An additional design feature that minimizes size and complexity of operation is that the note processing component of the apparatus of the present invention operates in only two dimensions. This allows the cash to remain perpendicular to the sides and panels of the device without changing planes more than once. Furthermore, the apparatus of the present invention utilizes a single driving motor for the transport belt component. These unique features combine to result in cash handling systems that are useful in a variety of settings where the deposit and recycling of cash is performed.

It will be further understood that additional apparatuses or systems of the present invention include a plurality of the individual units described above. Thus, in some embodiments, of the present invention apparatuses are provided that comprise at least one, or preferably two or more, individual cash handling units. These apparatuses can be arranged in a variety of configurations. For example, the individual units can be arranged side by side, or they can be physically separate, for example arranged at each checkout counter in a store. In preferred embodiments, the individual units are networked so as to be in communication with one another to act a single device or system.

In particularly preferred embodiments, the apparatus of the present invention may be installed in a countertop of a gasoline station, bank, grocery store or any other retail outlet or other setting where handling of cash is required. The apparatus of the present invention is not limited to use in particular countertop settings. Indeed, countertop is defined broadly herein to include any physical barrier between a customer utilizing an apparatus of the present invention and the storage components of the apparatus. In preferred embodiments, notes and coins are fed through the countertop through the single openings for notes and coins. The notes and coins are then automatically sorted by the apparatus into different denominations and stored below the countertop in the note and coin storage components. The stored notes and coins are then recycled for outflow cash and fed through the single note and coin openings, across the countertop, to the customer.

As can be seen, the apparatuses and systems of the present invention find a variety of uses. In particularly preferred embodiments, the apparatuses and systems provide for the reuse or recycling of money that is input into the system. In other words, money input into to the system by one user is stored and then is redistributed to another user of the system.

The coin recycling unit of the present invention also has many unique features. The unit features a single component, the upper rotating disk 415, that 1) separates coins from a batch of coins one by one; 2) transports the coins past a detection device; 3) transports coins to coin storage unit; 4) separates coins one by one during coin outfeed; and 5) transports the coins to an outfeed component. Furthermore, the coin recycling unit exhibits a great economy of space as the coins move less than 4 inches (vertical height) from infeed to storage to outfeed. The coin recycling unit is also different from previously described coin handling systems in that separation and transportation of coins is accomplished by rotating parts. Furthermore, the coin recycling unit of the present invention is different from prior art systems in that the coins are maintained in a horizontal orientation during coin separation, transportation, and storage. Additionally, separation and transport are performed with horizontally oriented components. Finally, the coin recycling unit of the present invention is unique in that the coins are stored in tube-shaped receptacles and are stacked upon each other. This is in contrast to other coin handling systems wherein the coins are stored in box and fed out through the bottom of the storage box.

B. The Apparatus in Use

The cash handling systems of the present invention find use in a variety of commercial (e.g., retail) and banking settings. The following examples are illustrative and are not meant to limit the present invention. One skilled in the art recognizes that systems such as those of the present invention find utility in additional settings requiring the handling and recycling of currency.

The cash handling systems of the present invention find particular utility in countries where a variety of currencies are utilized. For example, the capability of the apparatus of the present invention to recycle cash of multiple countries make it particularly suited for use in European Union (EU) countries where both the Euro and the currencies of the particular country are accepted. One can envision a customer entering a retail setting (e.g., a grocery store) in a EU country (e.g., Germany) and paying for a purchase in multiple denominations of Euros, Deutsch Marks, or a combination. The Euros and/or Deutsch Marks are input into an apparatus of the present invention. Depending on the customer's and business's preference, the apparatus provides change in multiple denominations of Deutsch Marks, Euros, or a combination. Alternatively, in a non EU country (e.g., in an Asian country), the customer pays for an receives change in the multiple denominations of the same currency. In some embodiments, the apparatus is run by an employee of the business. Alternatively, the entire transaction is automated, thus saving the added expense of hiring a cashier.

In some embodiments, the apparatus of the present invention finds use in self service retail settings such as gasoline fueling stations. For example, many such stations comprise user serviced terminals attached to gasoline pumps for purchasing fuel. Such stations typically are used only for credit or debit card purchases. However, the apparatus of the present invention allows customers to purchase fuel with cash (e.g., notes or coins) of multiple denominations and receive change in multiple denominations.

The apparatus of the present invention additionally finds use in bank settings (e.g., as an ATM or operated by a bank teller). In particular, the apparatus finds utility in banks in EU countries. Customers in such countries may desire to deposit and obtain funds in multiple currencies. For example, a bank customer in England may wish to obtain cash in Pounds and Euros. The customer can withdraw and deposit both Pounds and Euros into a bank account (e.g., via a teller operating an apparatus of the present invention or via an ATM). The apparatus of the present invention allows the teller (or ATM) to use a single cash handling apparatus for multiple cash deposits and withdraws, thus decreasing the added expense of purchasing multiple cash handling apparatuses for different currencies.

In additional embodiments, the cash handling system of the present invention finds use in an international airport in cash exchange applications. Travelers arriving from another country enter cash (e.g., from their home country or Euros in an EU country or a combination) and receive cash of the destination country or Euros in an EU country, or a combination. The automated nature of the apparatus of the present invention, as well as its capability to input and output multiple currencies, make it particularly suited for such an application.

All publications and patents mentioned in the above specification are herein incorporated by reference. Various modifications and variations of the described compositions and methods of the invention will be apparent to those skilled in the art without departing from the scope and spirit of the invention. Although the invention has been described in connection with specific preferred embodiments, it should be understood that the invention should not be unduly limited to such specific embodiments. Indeed, various modifications of the described modes for carrying out the invention which are obvious to those skilled in mechanics, engineering, electronics or related fields are intended to be within the scope of the following claims.

We claim:

1. An apparatus for processing coins comprising:

a first planar member having an opening therein, wherein the opening is configured to accept at least one coin;

a second planar member having an opening therein, wherein the opening is configured to accept at least one coin; and a plurality of coin storage units, each coin storage unit being for storing a single denomination of coin; wherein the first and second planar members are each moveable between at least a first and a second position, wherein in the first position the second planar member forms a floor for the opening in the first planar member and wherein in the second position the opening in the first planar member and the opening in the second planar member are aligned to form a passage for allowing a coin in the opening in the first planar member to travel through the opening in the second planar member into a respective one of the plurality of coin storage units, the second position is one of a plurality of discharge positions in which the first and second planar members are aligned respectively forming a passage to one coin storage unit of the plurality of coin storage units, the first planar member and the second planar member are moveable between the first position and the plurality of discharge positions.

2. Apparatus for processing coins as claimed in claim 1 in which the first planar member and the second planar member are disc-shaped.

3. Apparatus for processing coins as claimed in claim 1 wherein the first and second planar members rotate about a common axis.

4. Apparatus for processing coins as claimed in 3 wherein the axis is a vertical axis and the first and second planar members are in a generally horizontal orientation.

5. Apparatus for processing coins as claimed in claim 1 wherein the at least one coin storage unit is a tube and the coins are stored in a horizontal orientation in the tube.

6. Apparatus for processing coins as claimed in claim 1 wherein in each position of the plurality of discharge positions the opening in the first planar member and the opening in the second planar member are respectively aligned with one of the plurality of coin storage units.

7. Apparatus for processing coins as claimed in claim 1 further comprising a coin detection component for identifying the denomination of coins and respectively selecting the storage unit for each coin.

8. Apparatus for processing coins as claimed in claim 7 wherein the first and the second planar member are operatively positioned to maintain each coin in a generally horizontal position when the first planar member and the second planar member are moved between the first position and the one of the plurality of discharge positions for each coin.

9. Apparatus for processing coins as claimed in claim 1 further comprising a coin outfeed tube and a lift mechanism operatively connected to the at least one coin storage unit, wherein a coin to be outfed from the at least one coin storage unit is lifted by the lift mechanism through the opening in the second planar member and placed into the opening of the first planar member and the first planar member rotates with the coin positioned in the opening until the coin to be outfed is deposited in a coin outfeed tube.

10. Apparatus for processing coins as claimed in claim 8 in which all the coins that are to be outfed during a particular transaction are accumulated in the outfeed tube.

11. A method for processing a plurality of coins, the method comprising:

providing an apparatus for processing coins, the apparatus comprising a first planar member having an opening, a second planar member having an opening, and a plurality of coin storage units;

positioning the first planar member and the second planar member in a first position wherein the second planar member forms a floor below the opening in the first planar member;

when the first planar member and the second planar member are in the first position, receiving at least one coin of the plurality of coins in the opening in the first planar member; and positioning the first planar member and the second planar member in a second position wherein the opening in the first planar member and the opening in the second planar member are aligned to form a passage to a respective one of the plurality of coin storage units, the second position is one of a plurality of discharge positions in which the first and second planar members are aligned respectively forming a passage to one coin storage unit of the plurality of coin storage units, the first planar member and the second planar member are moveable between the first position and the plurality of discharge positions.

12. The method of claim 11 further comprising, when the first planar member and the second planar member are in the second position, transferring a coin from the opening in the first planar member through the opening in the second planar member and into the respective one of the plurality of coin storage units.

13. The method of claim 11 wherein positioning the first planar member and the second planar member comprises rotating the first planar member and the second planar member about a common axis.

14. The method of claim 13 wherein the common axis is vertical and the first and second planar members are in a generally horizontal position.

15. The method of claim 11 wherein the plurality of discharge positions comprises a first discharge position in which the first and second planar members are aligned for respectively depositing coins into one of the plurality of coin storage units, the method further comprising positioning the first planar member and the second planar member in a second discharge position for depositing coins into a second of the plurality of coin storage units.

16. The method of claim 15 wherein the apparatus further comprises a coin detection component, the method further comprises identifying the denomination of each coin of the plurality of coins and respectively selecting the storage unit for each coin of the plurality of coins.

17. The method of claim 16 wherein selecting the storage unit comprises positioning the first planar member and the second planar member in a respective discharge position of the plurality of discharge positions.

18. The method of claim 11 wherein the apparatus further comprises a coin outfeed tube and a lift mechanism operatively connected to the at least one coin storage unit, the method further comprising transferring a coin to be outfed from the at least one coin storage unit to the outfeed tube, the transferring comprising activating the lift mechanism and positioning the coin to be outfed into the opening of the first planar member and rotating the first planar member with the coin to be outfed in the opening of the first planar member until the coin to be outfed is deposited in the coin outfeed tube.

19. An apparatus for processing coins comprising:

a first planar member having an opening therein, wherein the opening is configured to accept at least one coin;

a second planar member having an opening therein, wherein the opening is configured to accept at least one coin, the first planar member and the second planar member being rotatable around a common axis of rotation; and a plurality of coin storage units;

wherein the first and second planar members comprise at least a first and a second position, wherein in the first position the second planar member forms a floor for the opening in the first planar member and wherein at least one of the first and second planar members rotates to a position corresponding to the second position wherein the first planar member and the second planar member are positioned such that the opening in the first planar member and the opening in the second planar member are in alignment to form a passage for allowing a coin in the opening in the first planar member to travel through the opening in the second planar member into a respective one of the plurality of coin storage units.

20. The apparatus for processing coins as claimed in claim 19 wherein the second position is one of a plurality of discharge positions in which the first and second planar members are rotatably aligned respectively forming a passage to a first coin storage unit of the plurality of coin storage units.

21. The apparatus of claim 20 wherein the second position is a first discharge position, the first and second planar members comprise a third position corresponding to a second discharge position, the first and second planar members being rotatably aligned in the second discharge position to form a passage to a second coin storage unit of the plurality of coin storage units.

* * * * *